US010079436B2

(12) United States Patent
Okunaga et al.

(10) Patent No.: US 10,079,436 B2
(45) Date of Patent: Sep. 18, 2018

(54) PLANAR ANTENNA

(71) Applicant: Nippon Pillar Packing Co., Ltd., Osaka (JP)

(72) Inventors: Takeshi Okunaga, Osaka (JP); Akira Nakatsu, Osaka (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 126 days.

(21) Appl. No.: 15/110,945

(22) PCT Filed: Feb. 4, 2015

(86) PCT No.: PCT/JP2015/053154
§ 371 (c)(1),
(2) Date: Jul. 12, 2016

(87) PCT Pub. No.: WO2015/129422
PCT Pub. Date: Sep. 3, 2015

(65) Prior Publication Data

US 2016/0359238 A1 Dec. 8, 2016

(30) Foreign Application Priority Data

Feb. 28, 2014 (JP) ..... 2014-039705

(51) Int. Cl.
*H01Q 1/38* (2006.01)
*H01Q 21/06* (2006.01)
(Continued)

(52) U.S. Cl.
CPC ..... *H01Q 21/065* (2013.01); *H01P 5/12* (2013.01); *H01Q 5/50* (2015.01); *H01Q 21/0075* (2013.01)

(58) Field of Classification Search
CPC ..... H01Q 1/38; H01Q 9/0407; H01Q 1/243; H01Q 9/0421
(Continued)

(56) References Cited

U.S. PATENT DOCUMENTS 6,057,747 A 5/2000 Takenoshita et al.
2008/0150821 A1 6/2008 Koch et al.
(Continued)

FOREIGN PATENT DOCUMENTS

JP S34-006816 8/1959
JP H06-326506 A 11/1994
(Continued)

OTHER PUBLICATIONS

Takahashi et al., "Radiation control of electromagnetic waves by the shape of curve part of microstripline," The Institute of Electronics, Information and Communication Engineers (IEICE) Technical Report, Nov. 20, 1998, vol. 98, No. 420, pp. 49-56 (Partial English translation attached).
(Continued)

*Primary Examiner* — Dameon E Levi
*Assistant Examiner* — Collin Dawkins
(74) *Attorney, Agent, or Firm* — Kilyk & Bowerox, P.L.L.C.

(57) ABSTRACT

[Object] To improve the directional characteristics of a planar antenna for a milliwave band as well as widening a bandwidth.
[Means for Settlement] A feed line 13 has a main feed line 21, two sub-feed lines 22, and a distributor S2 adapted to branch the main feed line 21 into the two sub-feed lines 22. The distributor S2 includes: two outer edges 30L and 30R formed as curved lines connecting both side edges 21L and 21R of the main feed line 21 to first edges 221 of the sub-feed lines 22; and an inner edge 31 connecting second edges 222 of the sub-feed lines 22 to each other, in which the inner edge 31 is configured to include two inner curved lines
(Continued)

31L and 31R that are convex in mutual directions, and has a pointed shape that is concave toward the main feed line 21 side.

4 Claims, 13 Drawing Sheets

(51) Int. Cl.
*H01P 5/12* (2006.01)
*H01Q 5/50* (2015.01)
*H01Q 21/00* (2006.01)

(58) Field of Classification Search
USPC ..... 343/700 MS, 702, 846, 848
See application file for complete search history.

(56) References Cited

U.S. PATENT DOCUMENTS

2009/0256777 A1* 10/2009 Nagai ..... H01Q 9/0407 343/893
2014/0009364 A1* 1/2014 Yehezkely ..... H01Q 21/0006 343/893

FOREIGN PATENT DOCUMENTS

| | | | |
|---|---|---|---|
| JP | H10-145112 | A | 5/1998 |
| JP | 2007-074206 | A | 3/2007 |
| JP | 2007-134897 | A | 5/2007 |
| JP | 2011-086975 | A | 4/2011 |
| KR | 10-1999-0052552 | A | 7/1999 |
| KR | 10-2009-0057537 | A | 6/2009 |

OTHER PUBLICATIONS

International Search Report issued in corresponding International Patent Application No. PCT/JP2015/053154 dated Apr. 21, 2015 with English translation (2 pages).

* cited by examiner

A-A CROSS-SECTIONAL VIEW

CONVENTIONAL EXAMPLE

PLANAR ANTENNA

This application is a National Stage Application of PCT/JP2015/053154, filed Feb. 4, 2015, which claims the priority of Japanese Patent Application No. 2014-039705, filed Feb. 28, 2014, which is incorporated herein by reference.

TECHNICAL FIELD

The present invention relates to a planar antenna, and more specifically, to improvement of a planar antenna in which a radiation pattern for radiating electromagnetic waves is formed on a dielectric substrate, for example, to improvement of a microstrip antenna that can be used for communication using radio waves in a microwave band or a milliwave band, or the like.

BACKGROUND ART

A microstrip antenna is a small-sized light-weight planar antenna that uses a microstrip line formed on a dielectric substrate to transceive electromagnetic waves in a microwave band or a milliwave band, and used as, for example, a monitoring radar antenna.

FIG. 11 is a diagram illustrating a configuration example of a conventional microstrip antenna (e.g., Patent Literature 1). The microstrip antenna is a planar antenna in which on the front surface of a dielectric substrate 10, an antenna pattern 11 is formed, and on the back surface of the dielectric substrate 10, a grounding plate is formed. The antenna pattern 11 is configured to include a feeding point 12, a feed line 13, and radiating elements 14, and power is fed from the feeding point 12 to the radiating elements 14 through the feed line 13.

The directional characteristics of the microstrip antenna can be improved by providing the two or more radiating elements 14; however, when attempting to connect the two or more radiating elements to the common feeding point 12, it is necessary to provide a distributor S3 on the feed line 13. The distributor S3 has a T-shaped pattern adapted to branch a main feed line 21 into two or more sub-feed lines 22, and the radiating elements 14 are respectively connected to the branched sub-feed lines 22.

In the case of providing the distributor S3 on the feed line 13, a characteristic impedance mismatch causes power reflection at the distributor S3 to reduce an antenna gain. For this reason, in a conventional microstrip antenna, an impedance transformer 26 called a λ4 transformer is provided. The impedance transformer 26 is an element inserted between the main feed line 21 and the distributor S3, and has a line width different from that of the main feed line 21 and a line length of ¼ wavelength. By providing such an impedance transformer 26, the reflection at the distributor S3 can be reduced to suppress the reduction in antenna gain.

However, the above-described conventional microstrip antenna has a problem that the impedance transformer 26 limits a bandwidth to prevent the achievement of a wideband microstrip antenna. For example, in the case of a microstrip antenna used in the 60 GHz band, when using the impedance transformer 26, the bandwidth is limited to approximately 1 GHz, and therefore the microstrip antenna cannot be used for a bandwidth of several GHz or more.

Further, the T-shaped pattern forming the distributor S3 radiates undesired waves, causing the problem that the radiation of the undesired waves reduces radiation efficiency or adversely affects directional characteristics.

PRIOR ART DOCUMENT

Patent Literature

[Patent Literature 1] WO2006/132032

SUMMARY OF INVENTION

Problem to be Resolved by Invention

The present invention is made in consideration of the above-described situations, and intends to provide a planar antenna adapted to suppress undesired radiation. Also, the present invention intends to provide a wideband planar antenna. In particular, the present invention intends to widen the bandwidth of a planar antenna used in a milliwave band while suppressing undesired radiation.

Means of Solving Problem

A planar antenna according to a first aspect of the present invention is a planar antenna adapted to feed power from a common feeding point to two or more radiating elements through a feed line, in which: the feed line has a main feed line, two sub-feed lines, and a distributor adapted to branch the main feed line into the two sub-feed lines; the distributor includes two outer edges formed as curved lines connecting both side edges of the main feed line to first edges of the sub-feed lines and an inner edge connecting second edges of the sub-feed part lines to each other; and the inner edge is configured to include two curved lines that are convex in mutual directions, and has a pointed shape that is concave toward a main feed line side.

By employing such a configuration, the outer edges and inner edges of the distributor can be configured as the curved lines along the branched paths. For this reason, undesired wave radiation from the distributor can be suppressed. Also, without using an impedance transformer, reflection can be suppressed to widen the bandwidth of a planar antenna.

A planar antenna according to a second aspect of the present invention is such that in addition to the above configuration, the inner edge is configured to include two arcs; and the outer edges are configured as arcs concentric with the above opposite arcs, respectively. By employing such a configuration, undesired wave radiation at the distributor can be more effectively suppressed.

A planar antenna according to a third aspect of the present invention is such that in addition to the above configuration, the sub-feed lines are both substantially orthogonal to the main feed line and extend in mutually opposite directions; and central angles of the outer edges of the distributor are substantially 90°. By employing such a configuration, an antenna pattern can be arranged on a smaller substrate to reduce manufacturing cost.

A planar antenna according to a fourth aspect of the present invention is a planar antenna adapted to feed power from a common feeding point to two or more radiating elements through a feed line, in which: the feed line has a distributor adapted to branch a main feed line on a feeding point side into two sub-feed lines on a radiating element side; the distributor has a shape formed by mutually superposing two connecting lines respectively connecting the main feed line to the two sub-feed lines; and the connecting lines have curved line shapes smoothly connecting the main feed line to the sub-feed lines, respectively.

A planar antenna according to a fifth aspect of the present invention is a planar antenna adapted to feed power from a common feeding point to three or more radiating elements through a feed line, in which: the feed line has a distributor adapted to branch a main feed line on a feeding point side into three sub-feed lines on a radiating element side; the distributor has a shape formed by mutually superposing three connecting lines respectively connected to the three sub-feed lines; a central one of the connecting lines has a substantially linear shape connected to a central one of the sub-feed lines, the central one of the sub-feed lines being coincident with the main feed line in terms of a center line; and ones on both sides of the connecting lines have curved line shapes smoothly connecting the main feed line to ones on both sides of the sub-feed lines, the ones on both sides of the sub feed lines being substantially orthogonal to the main feed line and extending in mutually opposite directions, respectively.

A planar antenna according to a sixth aspect of the present invention is such that in addition to the above configuration, the main feed line, the sub-feed lines, and the connecting lines all have substantially the same line width.

A planar antenna according to a seventh aspect of the present invention is such that in addition to the above configuration, curvature radii of center lines of the connecting lines are equal to or more than the line width.

Effects of Invention

According to the present invention, a planar antenna adapted to suppress undesired radiation can be provided. For this reason, the radiation efficiency of a planar antenna can be improved, or directional characteristics thereof can be improved. Also, a wideband planar antenna can be provided. In particular, the bandwidth of a planar antenna used in a milliwave band can be widened while suppressing undesired radiation.

DESCRIPTION OF EMBODIMENTS

Figure 1:
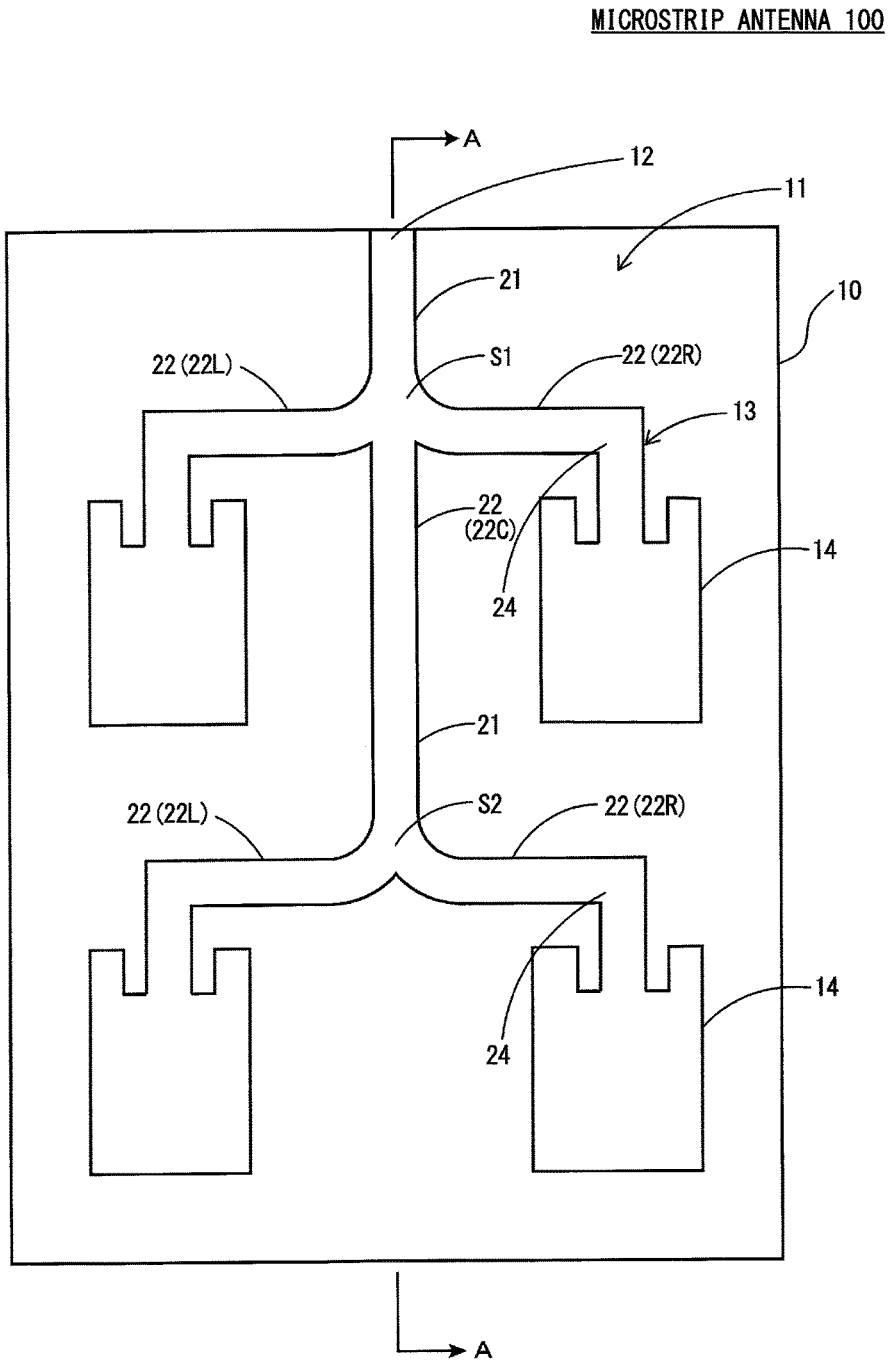
FIG. 1 is a plan view illustrating a configuration example of a microstrip antenna 100 according to an embodiment of the present invention.
Figure 2:
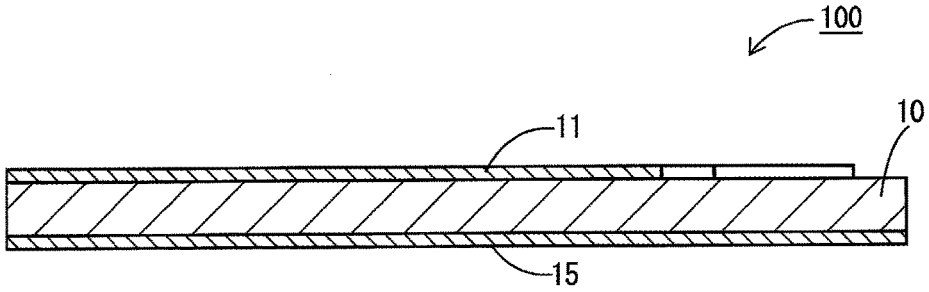
FIG. 2 is a cross-sectional view when cutting the microstrip antenna 100 of FIG. 1 along the A-A section line.

FIGS. 1 and 2 are diagrams illustrating a configuration example of a microstrip antenna 100 according to a first embodiment of the present invention. FIG. 1 is a plan view of the microstrip antenna 100, and FIG. 2 is a cross sectional view when cutting the microstrip antenna 100 of FIG. 1 along the A-A section line.

The microstrip antenna 100 is a small-sized light-weight antenna suitable for transmitting or receiving microwaves, and used for a wireless communication terminal, a small radar, and the like. The microstrip antenna 100 can be mounted in, for example, a portable communication terminal and used as a data communication antenna. In particular, the microstrip antenna 100 is suitable as a high-speed data communication antenna conforming to the WiGig (Wireless Gigabit) standard. In addition, the microstrip antenna 100 can also be mounted in a mobile body such as a vehicle and used as a transceiving antenna for a forward-looking radar.

The microstrip antenna 100 is a planar antenna in which electrically conductive layers are formed on both surfaces of a dielectric substrate 10. The dielectric substrate 10 is a flat plate-shaped substrate made of a dielectric having small relative permittivity, such as fluorine resin containing inorganic fiber. On the front surface of the dielectric substrate 10, an antenna pattern 11 is formed. The antenna pattern 11 is a strip line formed by etching electrically conductive metal foil, and configured to include a feeding point 12, a feed line 13, and two or more radiating element 14. On the other hand, on the back surface of the dielectric substrate 10, a grounding plate 15 made of electrically conductive metal covering substantially the entire surface is formed. That is, the antenna pattern 11 and the grounding plate 15 are arranged so as to face each other interposing the dielectric substrate 10 therebetween.

The feeding point 12 is a connecting point at which the antenna pattern 11 is connected to a high frequency circuit (not illustrated) such as a transceiving circuit, and the connection to the high frequency circuit is made in a well-known manner. For example, when arranging a wave guide on the back surface side of the dielectric substrate 10, and providing a waveguide-strip line converter on the dielectric substrate 10, one end of the feed line 13 arranged within the converter serves as the feeding point 12.

The feed line 13 has a long and narrow pattern connecting between the feeding point 12 and the radiating elements 14, and when transmitting an electromagnetic wave, power is supplied from the feeding point 12 to the radiating elements 14, whereas when receiving an electromagnetic wave, power is supplied in an opposite direction. Also, the feeding line 13 is provided with distributors S1 and S2.

Each of the radiating elements 14 is an element adapted to radiate an electromagnetic wave to free space. A planar antenna can obtain good directional characteristics by using two or more radiating elements 14. For this reason, the microstrip antenna 100 according to the present embodiment includes the four radiating elements 14. The radiating elements 14 are respectively connected to branched fore ends of the feed line 13, and connected to the common feeding point 12.

Each of the distributors S1 and S2 is a circuit element adapted to branch one feed line on the feeding point 12 side into two or more feed lines on the radiating element 14 side. The feed line connected to the feeding point 12 is branched into three feed lines at the distributor S1. Among the branched three feed lines, the central branched line is further branched into two feed lines at the distributor S2. In this description, among feed lines connected to the distributor S1 or S2 of interest, a feed line on the feeding point 12 side is referred to as a main feed line 21, and feed lines on the radiating element 14 side are referred to as sub-feed lines 22.

That is, the distributor S1 is a circuit element adapted to branch the main feed line 21 into the three sub-feed lines 22, and the distributor S2 is a circuit element adapted to branch the main feed line 21 into the two sub-feed lines 22.

The main feed line 21 of the distributor S1 is a linear-shaped feed line connected to the feeding point 12. The central sub-feed line 22C of the distributor S1 is a linear-shaped feed line of which the center line is substantially coincident with that of the main feed line 21 of the distributor S1. The sub-feed lines 22L and 22R on both sides of the distributor S1 are connected with the radiating elements 14 at the fore ends thereof, respectively. Also, the sub-feed lines 22L and 22R have bending parts 24, are substantially orthogonal to the main feed line 21 on the distributor S1 sides of the bending parts 24, and extend in mutually opposite directions, respectively. On the other hand, on the radiating element 14 sides of the bending parts 24, the sub-feed lines 22L and 22R extend substantially parallel to the main feed line 21.

The main feed line 21 of the distributor S2 is the central sub-feed line 22C of the distributor S1. The two sub-feed lines 22L and 22R of the distributor S2 are connected with the radiating elements 14 at the fore ends thereof, respectively. Also, the sub-feed lines 22L and 22R have bending parts 24, are substantially orthogonal to the main feed line 21 on the distributor S2 sides of the bending parts 24, and extend in mutually opposite directions, respectively. On the other hand, on the radiating element 14 sides of the bending parts 24, the sub-feed lines 22L and 22R extend substantially parallel to the main feed line 21.

Note that in the present embodiment, an example of the case where the sub-feed lines 22L and 22R have linear shapes respectively bent at a right angle at the bending parts 24 is described; however, the bending parts 24 may have smoothly curved shapes, respectively. For example, the bending parts 24 may have arc shapes allowing the curvature radii of the center lines of the sub-feed lines 22L and 22R to be equal to or more than the widths of the sub-feed lines 22L and 22R.

<Distributor S2>

Figure 3:
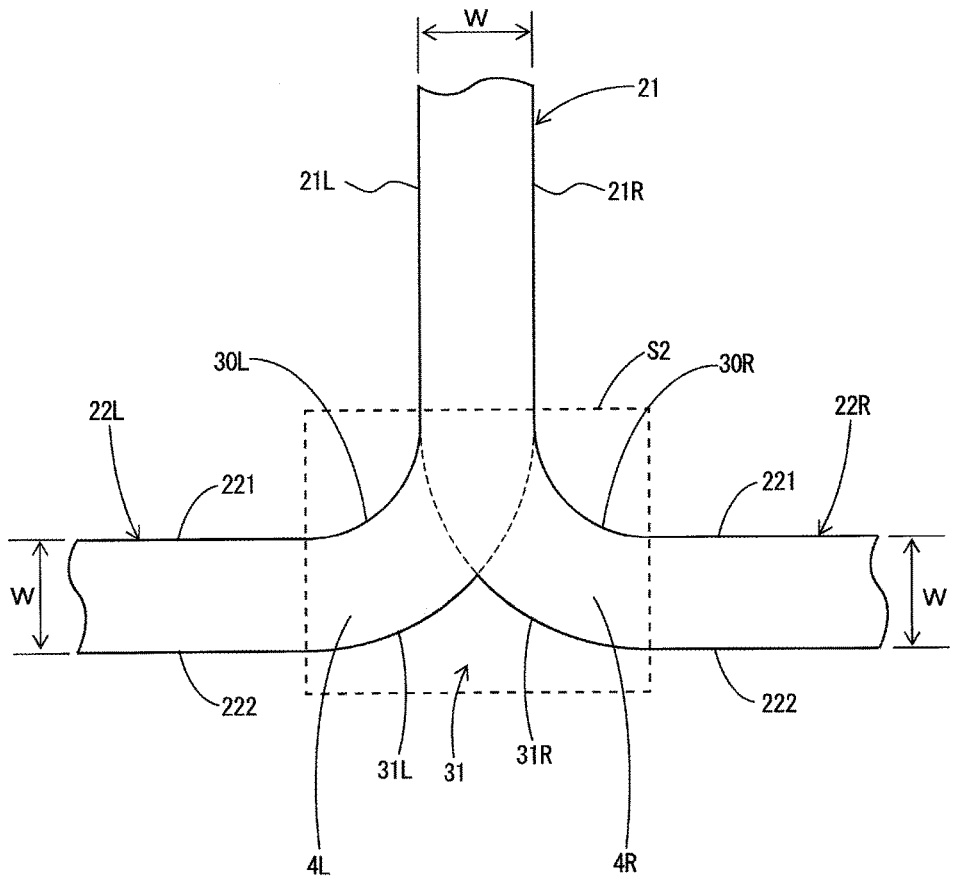
FIG. 3 is an explanatory diagram for explaining the detailed configuration of a distributor S2.

FIG. 3 is an explanatory diagram for explaining the detailed configuration of the distributor S2, in which the distributor S2 in FIG. 1 and its periphery are enlarged and illustrated. The distributor S2 has a shape line-symmetrical with respect to the center line of the main feed line 21.

The distributor S2 has a shape formed by mutually superposing two connecting lines 4L and 4R respectively having smoothly curved shapes. The connecting line 4L is a feeding path that has a shape formed by extending and curving the main feed line 21 and smoothly connects the main feed line 21 to the left sub-feed line 22L. Similarly, the connecting line 4R is also a feeding path that has a shape formed by extending and curving the main feed line 21 and smoothly connects the main feed line 21 to the right sub-feed line 22R. The distributor S2 has an area surrounded by outer edges 30L and 30R and an inner edge 31, and is surrounded by the smoothly curved edges extending along the feed lines. The shape of the distributor S2 will be described in more detail.

The main feed line 21 has a constant line width W, a linear shape extending in a top-bottom direction, and both side edges 21R and 21L. The sub-feed lines 22L and 22R have a constant line width W coincident with that of the main feed line 21, and also respectively have first edges 221 closer to the main feed line 21 and second edges 222 farther from the main feed line 21.

The left outer edge 30L is a curved line smoothly connecting the left side edge 21L of the main feed line 21 and the first edge 221 of the left sub-feed line 22L. Similarly, the right outer edge 30R is a curved line smoothly connecting the right side edge 21R of the main feed line 21 and the first edge 221 of the right sub-feed line 22R. These outer edges 30L and 30R respectively have shapes concave inward of the distributor S2.

The inner edge 31 is configured to include two inner curved lines 31L and 31R. One ends of the inner curved lines 31L and 31R smoothly connect to the second edges 222 of the left and right sub-feed lines 22L and 22R, respectively. Also, the inner curved lines 31L and 31R are curved lines convex in mutual directions. The inner edge 31 is formed by connecting the other ends of the inner curved lines 31L and 31R to each other, and has a pointed shape convex inward of the distributor S2, i.e., toward the main feed line 21 side.

Figure 4:
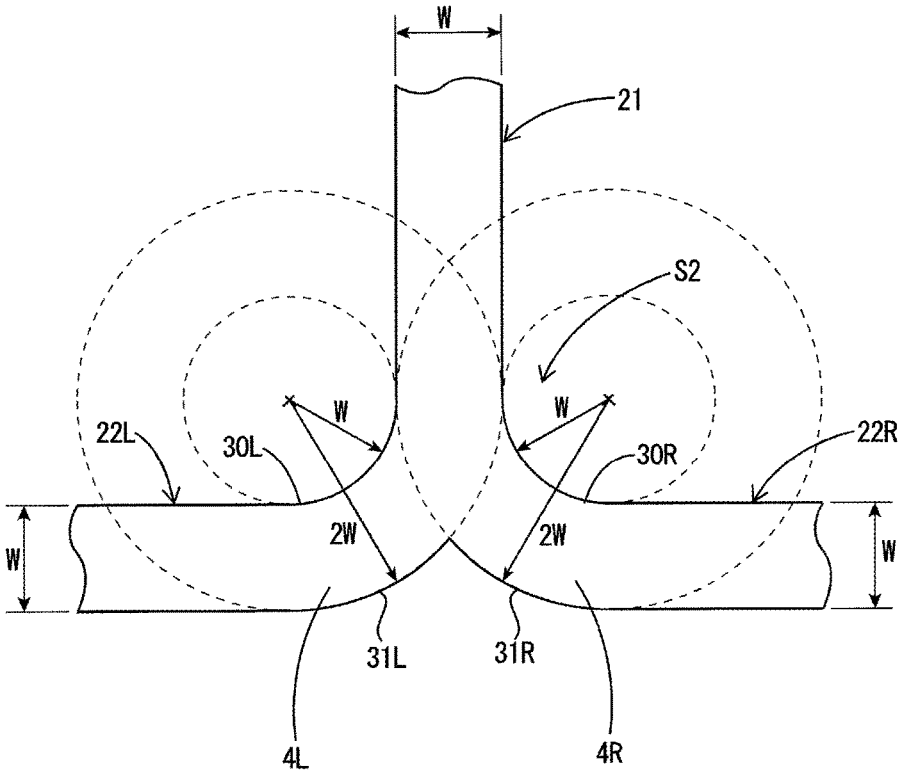
FIG. 4 is a diagram illustrating an example of a desired shape of the distributor S2.
Figure 5A:
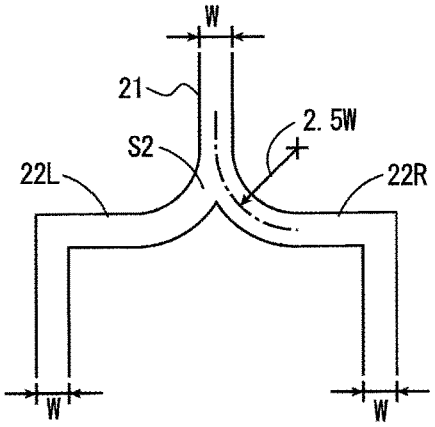
FIG. 5 is a diagram illustrating distributors S2 according to the present embodiment and a conventional distributor to be compared.
Figure 5B:
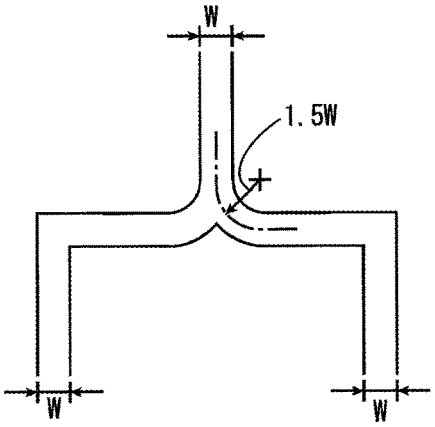
Figure 5C:
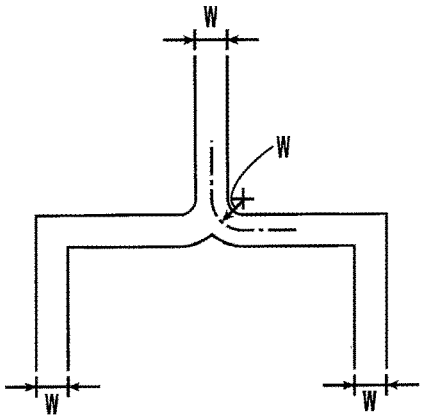
Figure 5D:
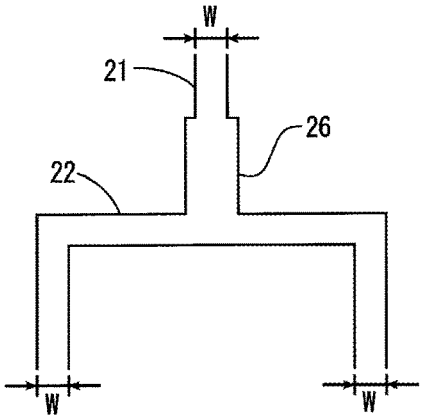

FIG. 4 is a diagram illustrating an example of a desired shape of the distributor S2. The two connecting lines 4L and 4R constituting the distributor S2 are arc-shaped, and have substantially the same line width W as those of the main feed line 21 and the sub-feed lines 22. A more detailed description is as follows.

The left outer edge 30L and left inner curved line 31L of the distributor S2 are configured as arcs of concentric circles, and the center of the concentric circles is arranged on the left side of the main feed line 21. The radius of the outer edge 30L is W, and the radius of the inner curved line 31L is 2W. That is, the connecting line 4L has an arc shape of which the line width is W and the curvature radius of the center line is 1.5W.

In a completely similar manner, the right outer edge 30R and right inner curved line 31RL of the distributor S2 are configured as arcs of concentric circles, and the center of the concentric circles is arranged on the right side of the main feed line 21. The radius of the outer edge 30R is W, and the radius of the inner curved line 31R is 2W. That is, the connecting line 4R has an arc shape of which the line width is W and the curvature radius of the center line is 1.5W.

<Undesired Radiation Suppressing Effect in Distributor S2>

FIGS. 5 and 6 are diagrams illustrating an undesired radiation suppressing effect produced by the microstrip antenna 100 according to the present embodiment. FIGS. 5(*a*) to 5(*d*) illustrate four different distributors, respectively. Any of the distributors has a pattern adapted to branch a main feed line 21 into two sub-feed lines 22, in which the sub-feed lines 22 are orthogonal to the main feed line 21 and extend in mutual directions, respectively. Also, in any of the cases, the line widths W of the main feed line 21 and sub-feed lines 22L and 22R are 0.35 mm.

The distributors in (a) to (c) are examples of the distributor S2 provided in the microstrip antenna 100 according to the present embodiment, and in any of the distributors S2, the connecting lines 4L and 4R are of arc shapes having a line width W, while the curvature radii of the arc shapes are different from each other. The curvature radii of the center lines of the connecting lines 4L and 4R are 2.5W in (a), 1.5W in (b), and W in (c). On the other hand, the distributor in (d) is a conventional distributor to be compared with (a) to (c), and has a T-shape not using any curved line, on the main feed line 21 side of which, an impedance transformer 26 is provided.

Figure 6A:
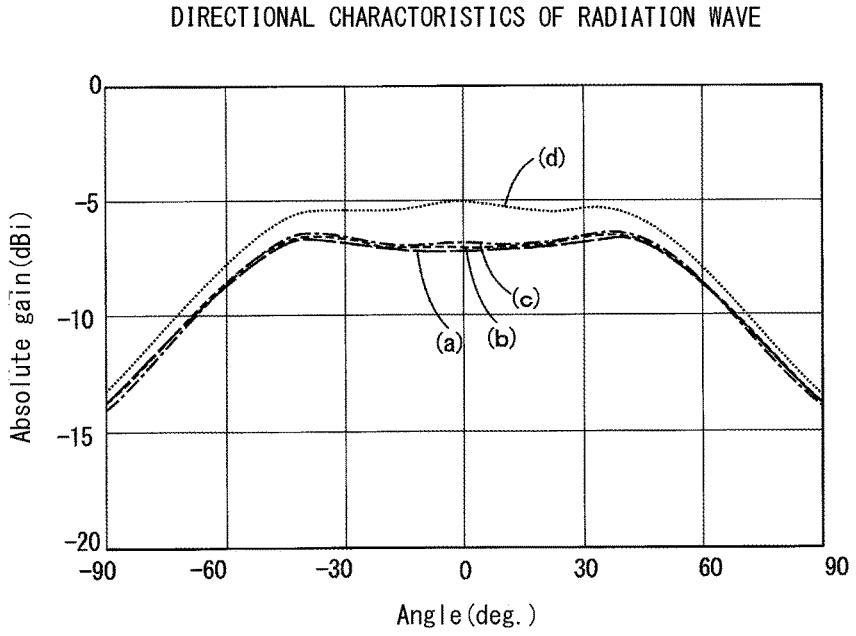
FIG. 6 is a diagram illustrating the gain of undesired radiation in each of the distributors in FIG. 5.
Figure 6B:
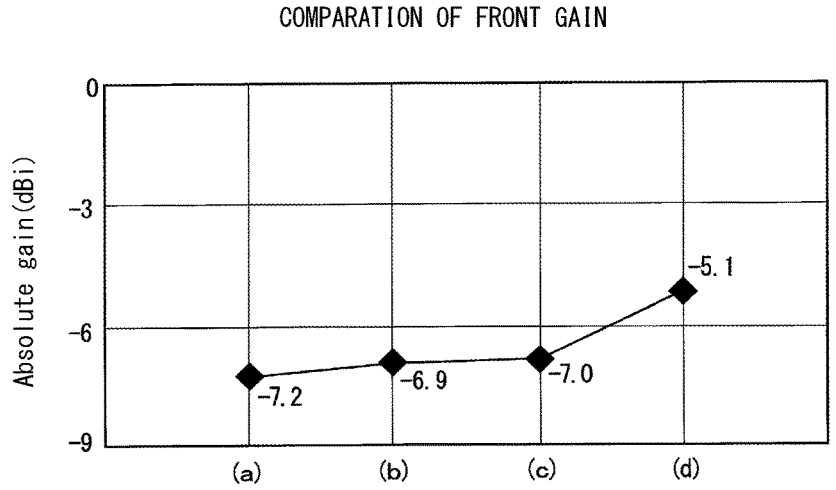

FIGS. 6(A) and 6(B) are diagrams respectively illustrating the gains of a radiation wave from each of the distributors (a) to (d) in FIG. 5, in which values obtained by simulation are indicated. FIG. 6(A) is a diagram illustrating directional characteristics regarding the vertical direction, in which the characteristics are illustrated with the vertical axis representing the absolute gain of an undesired radiation wave, and the horizontal axis representing a directional angle. FIG. 6(B) illustrates the absolute gain in a front direction, i.e., a value when the angle in FIG. 6(A) is 0 degrees. Both of the absolute gains are the gains of an undesired wave radiated from a branching part, and desirably have smaller values. In addition, transmission amounts of the distributors (a) to (d) are separately obtained. The results are summarized as follows.

TABLE 1

| | Shape of Distributor | | | |
|---|---|---|---|---|
| | (a) | (b) | (c) | (d) |
| Transmission Amount (dB) | −3.81 | −4.11 | −4.22 | −4.03 |
| Front Gain of Undesired Wave (dBi) | −7.2 | −6.9 | −7.0 | −5.1 |

When comparing (a) to (c) with (d), there is no large difference in the transmission amount, whereas a large difference appears in the gain of a radiation wave from a distributor. That is, it turns out that as compared with the conventional distributor (d) having the impedance transformer 26, in the case of the distributors (a) to (c) according to the present embodiment, no significant difference appears in reflection occurring at a distributor. In addition to this, it turns out that in the case of the distributors (a) to (c) according to the present embodiment, as compared with the conventional distributor (d), the front gain of an undesired radiation wave is significantly reduced. Also, it turns out that in the case where the line widths of the connecting lines 4L and 4R are W, as long as the curvature radii of the center lines of the connecting lines 4L and 4R are W or more, the front gain of an undesired radiation wave can be reduced.

<Distributor S1>

Figure 7:
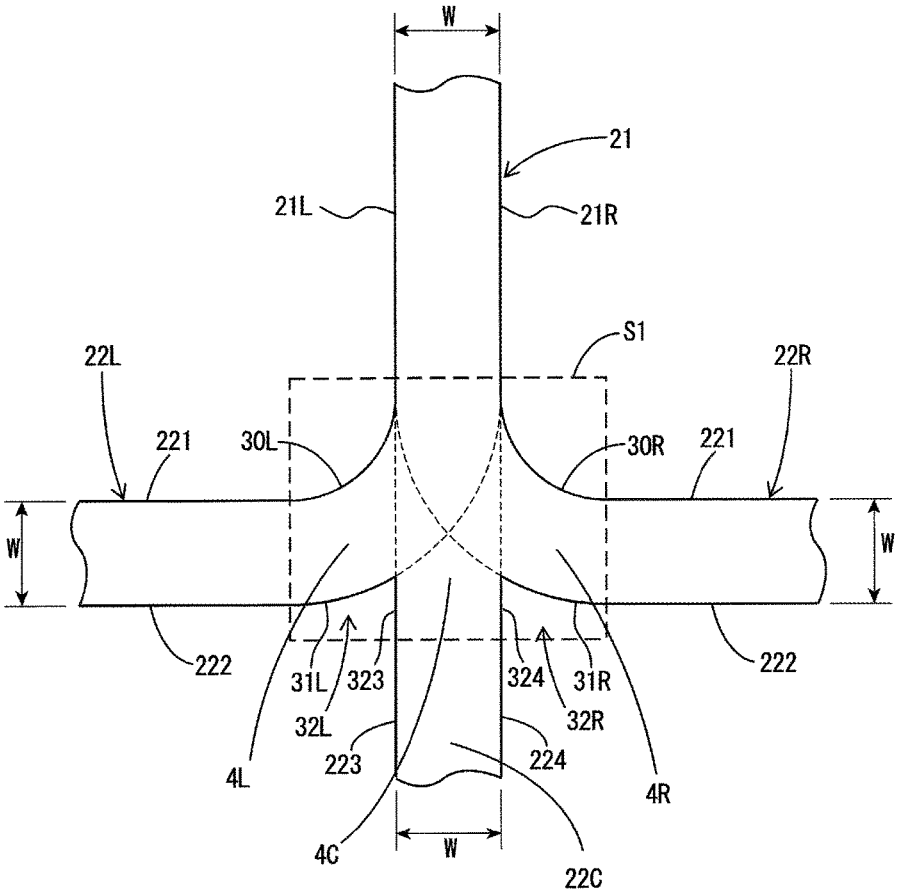
FIG. 7 is an explanatory diagram for explaining the detailed configuration of a distributor S1.

FIG. 7 is an explanatory diagram for explaining the detailed configuration of the distributor S1, in which the distributor S1 in FIG. 1 and its periphery are enlarged and illustrated. The distributor S1 has a shape line-symmetrical with respect to the center line of the main feed line 21.

The distributor S1 has a shape formed by mutually superposing a connecting line 4C having a linear shape and two connecting lines 4L and 4R respectively having smoothly curved shapes. The connecting line 4C is a feeding path that has the linear shape formed by extending the main feed line 21 and connects the main feed line 21 to the central sub-feed line 22C. The connecting line 4L is a feeding path that has a shape formed by extending and curving the main feed line 21 and smoothly connects the main feed line 21 to the left sub-feed line 22L. Similarly, the connecting line 4R is also a feeding path that has a shape formed by extending and curving the main feed line 21 and smoothly connects the main feed line 21 to the right sub-feed line 22R. The distributor S1 has an area surrounded by outer edges 30L and 30R and inner edges 32L and 32R, and is surrounded by the curved line and straight line edges formed along the three feeding paths. The shape of the distributor S1 will be described in more detail.

The main feed line 21 has a constant line width W, a linear shape extending in a top-bottom direction, and both side edges 21R and 21L. The three sub-feed lines 22L, 22C, and 22R have a constant line width W coincident with that of the main feed line 21. Also, the sub-feed lines 22L and 22R on both sides have first edges 221 closer to the main feed line 21 and second edges 222 farther from the main feed line 21, respectively, and the central sub-feed line 22C has both side edges 223 and 224.

The left outer edge 30L is a curved line smoothly connecting the left side edge 21L of the main feed line 21 and the first edge 221 of the left sub-feed line 22L. Similarly, the right outer edge 30R is a curved line smoothly connecting the right side edge 21R of the main feed line 21 and the first edge 221 of the right sub-feed line 22R. These outer edges 30L and 30R respectively have shapes concave inward of the distributor S1.

The left inner edge 32L is configured to include an inner curved line 31L and an inner straight line 323. One end of the inner curved line 31L is smoothly connected to the second edge 222 of the left sub-feed line 22L. The inner straight line 323 is smoothly connected to the left side edge 223 of the central sub-feed line 22C. Also, the inner curved line 31L is a curved line convex toward the inner straight line 323. The left inner edge 32L is formed by connecting the inner curved line 31L and the inner straight line 323, and has a pointed shape convex inward of the distributor S1, i.e., toward the main feed line 21 side.

The right inner edge 32R is configured to include an inner curved line 31R and an inner straight line 324. One end of the inner curved line 31R is smoothly connected to the second edge 222 of the right sub-feed line 22R. The inner straight line 324 is smoothly connected to the right side edge 224 of the central sub-feed line 22C. Also, the inner curved line 31R is a curved line convex toward the inner straight line 324. The right inner edge 32R is formed by connecting the inner curved line 31R and the inner straight line 324, and has a pointed shape convex inward of the distributor S1, i.e., toward the main feed line 21 side.

Figure 8:
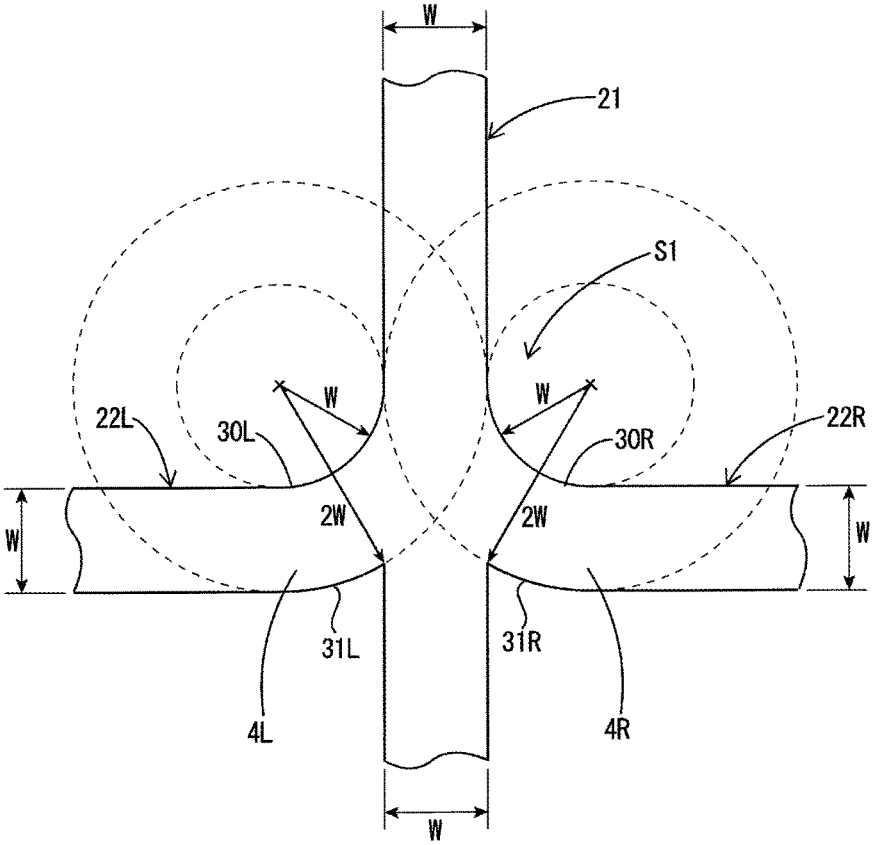
FIG. 8 is a diagram illustrating an example of a desired shape of the distributor S1.

FIG. 8 is a diagram illustrating an example of a desired shape of the distributor S1. The two connecting lines 4L and 4R constituting the distributor S1 are arc-shaped, and have substantially the same line width W as those of the main feed line 21 and the sub-feed lines 22L, 22C, and 22R. A more detailed description is as follows.

The left outer edge 30L and left inner curved line 31L of the distributor S1 are configured as arcs of concentric circles, and the center of the concentric circles is arranged on the left side of the main feed line 21. The radius of the outer edge 30L is W, and the radius of the inner curved line 31L is 2W. That is, the connecting line 4L has an arc shape of which the curvature radius of the center line is 1.5W.

In a completely similar manner, the right outer edge 30R and right inner curved line 31R of the distributor S1 are configured as arcs of concentric circles, and the center of the concentric circle is arranged on the right side of the main feed line 21. The radius of the outer edge 30R is W, and the radius of the inner curved line 31R is 2W. That is, the connecting line 4R has an arc shape of which the curvature radius of the center line is 1.5W.

<Undesired Radiation Suppressing Effect in Distributor S1>

Figure 9:
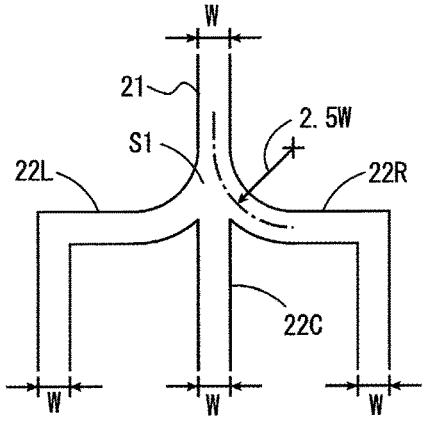
FIG. 9 is a diagram illustrating distributors S1 according to the present embodiment and a conventional distributor to be compared.
Figure 9B:
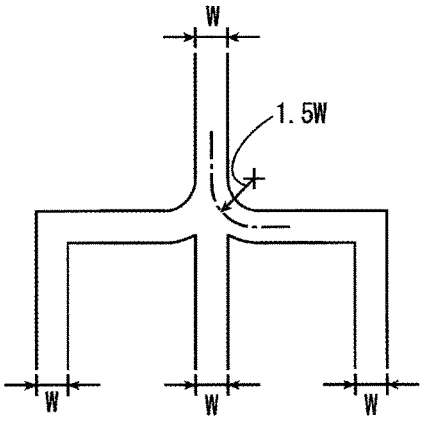
Figure 9C:
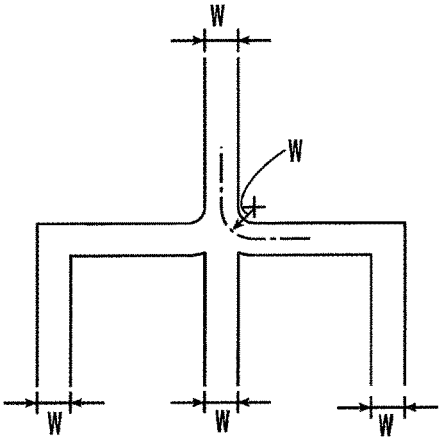
Figure 9D:
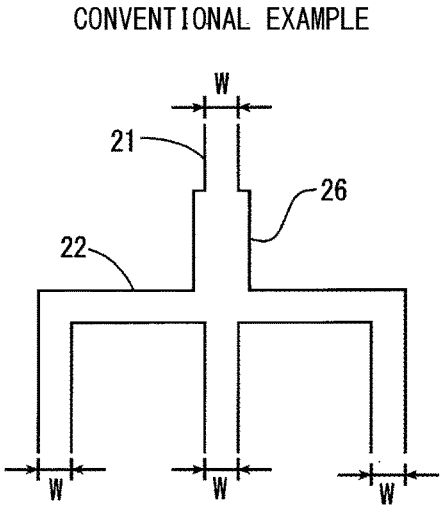

FIGS. 9 and 10 are diagrams illustrating an undesired radiation suppressing effect produced by the microstrip antenna 100 according to the present embodiment. FIGS. 9(*a*) to 9(*d*) illustrate four different distributors, respectively. Any of the distributors has a pattern adapted to branch a main feed line 21 into three sub-feed lines 22L, 22C, and 22R, in which the center line of the central sub-feed line 22C is coincident with that of the main feed line 21, and the sub-feed lines 22L and 22R on both sides are orthogonal to the main feed line 21 and extend in mutual directions. Also, in any of the cases, the line widths W of the main feed line 21 and sub-feed lines 22L, 22C, and 22R are 0.35 mm.

The distributors in (a) to (c) are examples of the distributor S1 provided in the microstrip antenna 100 according to the present embodiment, and in any of the distributors S1, the connecting lines 4L and 4R are of arc shapes having a line width W, while the curvature radii of the arc shapes are different from each other. The curvature radii of the center lines of the connecting lines 4L and 4R are 2.5W in (a), 1.5W in (b), and W in (c). On the other hand, the distributor in (d) is a conventional distributor to be compared with (a) to (c), and has a cross shape not using any curved line, on the main feed line 21 side of which, an impedance transformer 26 is provided.

Figure 10A:
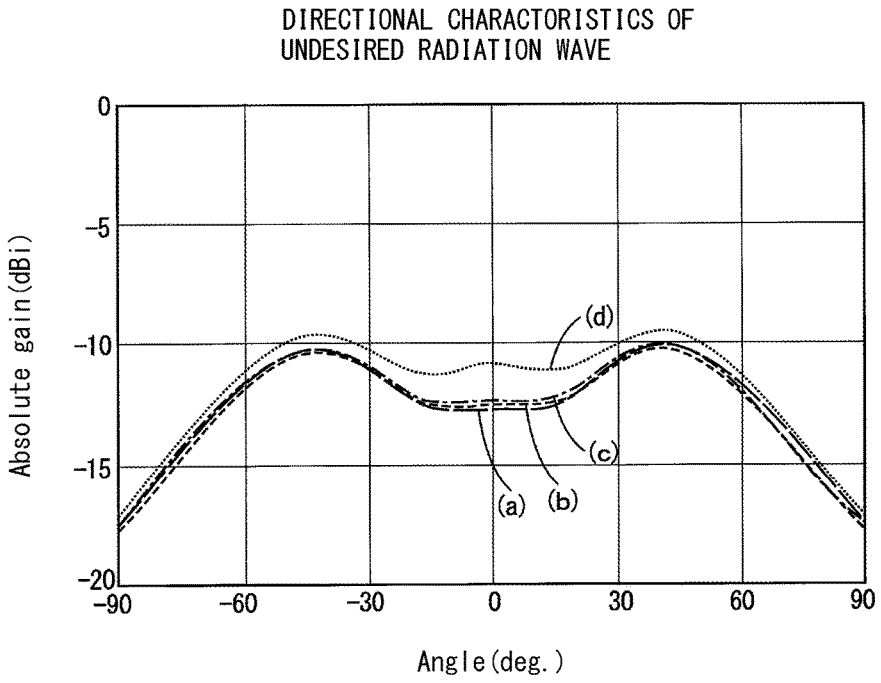
FIG. 10 is a diagram illustrating the gain of undesired radiation in each of the distributors in FIG. 9.
Figure 10B:
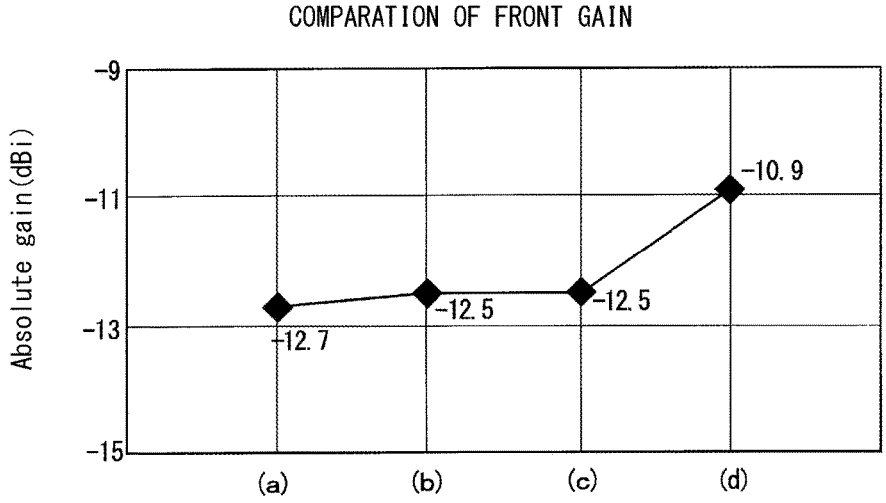
Figure 11:
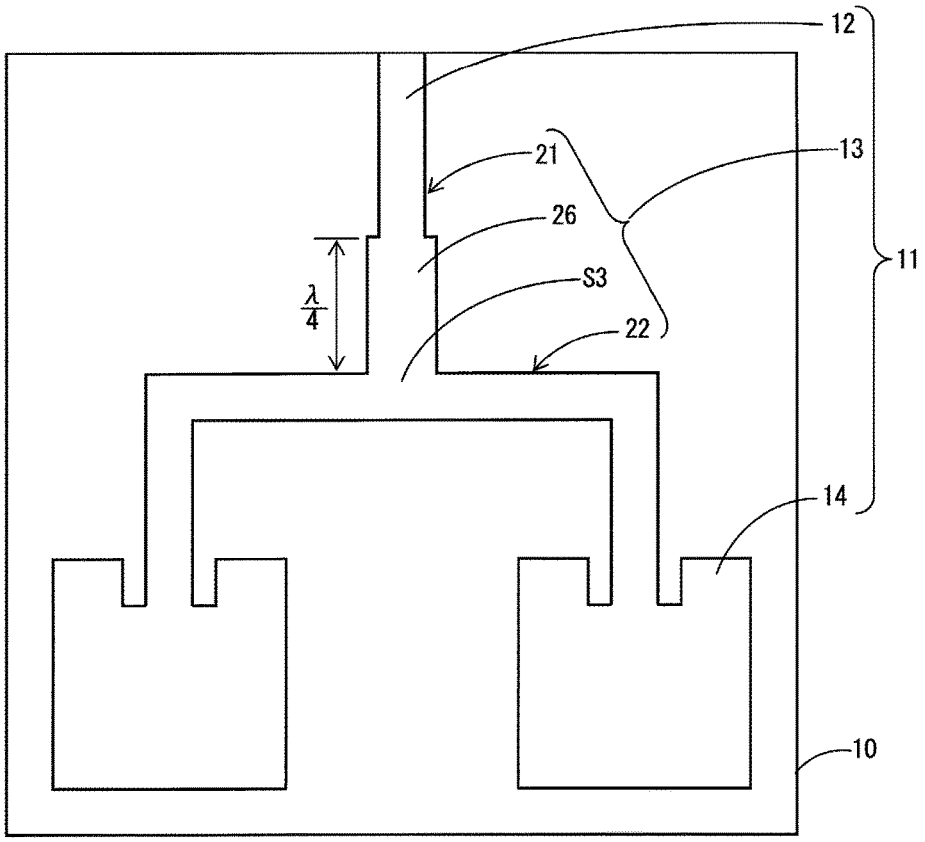
FIG. 11 is a diagram illustrating a configuration example of a conventional microstrip antenna.

FIGS. 10(A) and 10(B) are diagrams respectively illustrating the gains of a radiation wave from each of the distributors in FIG. 9, in which values obtained by simulation are indicated. FIG. 10(A) is a diagram illustrating directional characteristics regarding the vertical direction, in which the characteristics are illustrated with the vertical axis representing the absolute gain of an undesired radiation wave, and the horizontal axis representing a directional angle. FIG. 10(B) illustrates the absolute gain in a front direction, i.e., a value when the angle in FIG. 10(A) is 0 degrees. Both of the absolute gains are the gains of an undesired wave radiated from a branching part, and desirably have smaller values.

When comparing (a) to (c) with (d), there is a large difference in the gain of a radiation wave from a distributor. That is, it turns out that as compared with the conventional distributor (d), in the case of the distributors (a) to (c) according to the present embodiment, the front gain of an undesired radiation wave is significantly reduced. Also, it turns out that in the case where the line widths of the connecting lines 4L and 4R are W, as long as the curvature radii of the center lines of the connecting lines 4L and 4R are W or more, the front gain of an undesired radiation wave can be reduced.

The microstrip antenna 100 according to the present embodiment is a planar antenna adapted to feed power from the common feeding point 12 to the two or more radiating elements 14 through the feed line 13, in which the feed line 13 has the distributor S2 adapted to branch the main feed line 21 on the feeding point 12 side into the two sub-feed lines 22L and 22R on the radiating element 14 side, the distributor S2 has the shape formed by mutually superposing the two connecting lines 4L and 4R respectively connected to the two sub-feed lines 22L and 22R, and the connecting lines 4L and 4R have the curved line shapes adapted to smoothly connect the main feed line 21 to the sub-feed lines 22L and 22R, respectively.

That is, the distributor S2 includes: the two outer edges 30L and 30R formed as curved lines that connect the both side edges 21L and 21R of the main feed line 21 to the first edges 221 of the sub-feed lines 22L and 22R; and the inner edge 31 that connects the second edges 222 of the sub-feed lines 22 to each other, in which the inner edge 31 is configured to include the two inner curved lines 31L and 31R convex in mutual directions and have a pointed shape concave toward the main feed line 21 side.

By employing such a configuration, the outer edges 30L and 30R and inner edge 31 of the distributor S2 can be configured as the curved lines extending along the power propagation paths. For this reason, an undesired wave can be suppressed from being radiated from the distributor S2. Accordingly, the radiation efficiency of the microstrip antenna 100 can be improved, or directional characteristics thereof can be improved. In addition, without using an impedance transformer, reflection at the distributor S2 can be suppressed to widen the bandwidth of the microstrip antenna 100.

In general, the speed of wireless communication can be increased when using a shorter wavelength band, and the capacity of wireless communication can be increased when using a wider bandwidth. For this reason, in the WiGig standard on high-speed wireless communication, it is assumed to use a bandwidth of 7 to 9 GHz in the 60 GHz band. According to the present invention, a small-sized light-weight planar antenna that can be used for such wideband wireless communication in a milliwave band can be provided.

Also, in the microstrip antenna 100 according to the present embodiment, the inner curved lines 31L and 31R constituting the inner edge 31 are both configured as arcs, and the outer edges 30L and 30R are also configured as arcs concentric with the opposite inner curved lines 31L and 31R, respectively. For this reason, undesired wave radiation at the distributor S1 can be more effectively suppressed.

Further, the microstrip antenna 100 according to the present embodiment is configured such that the two sub-feed lines 22L and 22R are both substantially orthogonal to the main feed line 21 and extend in mutually opposite directions, and the outer edges 30L and 30R of the distributor S2 are arcs of which the central angles are substantially 90°. For this reason, the antenna pattern 11 can be arranged on a smaller substrate to reduce manufacturing cost.

For example, when forming the distributor S2 in a Y-shape, as compared with the case of a T-shape, it is considered that reflection can be suppressed, or an undesired radiation wave can be suppressed. However, when attempting to arrange two radiating elements 14 at a predetermined interval, it is necessary to ensure a long distance from the distributor S2 to each of the radiating elements 14, increasing the size of an antenna. On the other hand, in the microstrip antenna 100 according to the present embodiment, since the sub-feed lines 22 are made substantially orthogonal to the main feed line 21, manufacturing cost can be reduced without significantly increasing the size of the antenna pattern 11.

Also, the microstrip antenna 100 according to the present embodiment is a planar antenna adapted to feed power from the common feeding point 12 to the three or more radiating elements 14 through the feed line 13, in which the feed line 13 has the distributor S1 adapted to branch the main feed line 21 on the feeding point 12 side into the three sub-feed lines 22 on the radiating element 14 side. The distributor S1 has a shape formed by mutually superposing the three connecting lines 4L, 4C, and 4R respectively connected to the three sub-feed lines 22L, 22C, and 22R. The central connecting line 4C has a substantially linear shape connecting the main feed line 21 to the central sub-feed line 22C of which the center line is substantially coincident with that of the main feed line 21. The connecting lines 4L and 4R on both sides are curved line shapes smoothly connecting the main feed line 21 to the sub-feed lines 22L and 22R on the both sides, which are substantially orthogonal to the main feed line 21 and extend in mutually opposite directions.

That is, the distributor S1 includes the two outer edges 30L and 30R, and the two inner edges 32L and 32R. The two outer edges 30L and 30R are curved lines that connect the both side edges 21L and 21R of the main feed line 21 to the first edges 221 of the sub-feed lines 22L and 22R on the both sides, respectively. Also, the left inner edge 32L is configured to include the inner straight line 323 and the inner curved line 31L convex toward the inner straight line 323, and has a pointed shape concave toward the main feed line 21 side. Similarly, the right inner edge 32R is configured to include the inner straight line 324 and the inner curved line 31R convex toward the inner straight line 324, and has a pointed shape concave toward the main feed line 21 side.

By employing such a configuration, the outer edges 30L and 30R and inner edges 32L and 32R of the distributor S1 can be configured using the curved lines and straight lines extending along the power propagation paths. For this reason, undesired wave radiation from the distributor S1 can be suppressed. Accordingly, the radiation efficiency of the microstrip antenna 100 can be improved, or directional characteristics thereof can be improved. Also, without using an impedance transformer, reflection at the distributor S1 can be suppressed to widen the bandwidth of the microstrip antenna 100.

Note that in the above-described embodiment, as a desired example, the case where the outer edges 30L and 30R and inner curved lines 31L and 31R of each of the distributors S1 and S2 are all arcs is taken to give the description; however, the present invention is not limited to only such a case. For example, each of the above edges may be configured as a part of an ellipse or a parabola.

Further, in the present embodiment, the example where the antenna pattern 11 includes the two or more different distributors S1 and S2 is described; however, the present invention is not limited to only such a case. For example, the present invention can also be applied to a planar antenna in which an antenna pattern 11 includes only one distributor. In addition, the present invention can also be applied to a planar antenna in which an antenna pattern 11 includes two or more distributors of the same type.

DESCRIPTION OF REFERENCE NUMERALS

4L, 4C, 4R Connecting line
10 Dielectric substrate
11 Antenna pattern
12 Feeding point
13 Feed line
14 Radiating element
15 Grounding plate
21 Main feed line
21L, 21R Side edge of main feed line
22, 22L, 22C, 22R Sub-feed line
221 First edge of sub-feed line
222 Second edge of sub-feed line
223 Left side edge of sub-feed line
224 Right side edge of sub-feed line
24 Bending part
26 impedance transformer
30L, 30R Outer edge
31 Inner edge
31L, 31R Inner curved line
32L, 32R Inner edge
323, 324 Inner straight line
100 Microstrip antenna
S1, S2 Distributor
W Width of line

The invention claimed is:

1. A planar antenna adapted to feed power from a common feeding point to two or more radiating elements through a feed line, wherein:

said feed line has a distributor adapted to branch a main feed line on a feeding point side into two sub-feed lines on a radiating element side;

said distributor includes two outer edges smoothly connecting both side edges of said main feed line to first edges of said sub-feed lines and an inner edge connecting second edges of said sub-feed lines to each other;

said inner edge is configured to include two arcs that are convex in mutual directions, and has a pointed shape that is concave toward a side of the main feed line, and said inner edge and said outer edges that are opposite to each other are configured as arcs concentric with each other.

2. The planar antenna according to claim 1, wherein:

said sub-feed lines are both substantially orthogonal to said main feed line and extend in mutually opposite directions; and central angles of said outer edges of said distributor are substantially 90°.

3. A planar antenna adapted to feed power from a common feeding point to three or more radiating elements through a feed line, wherein:

said feed line has a distributor adapted to branch a main feed line on a feeding point side into three sub-feed lines on a radiating element side;

said distributor has a shape formed by mutually superposing three connecting lines respectively connected to said three sub-feed lines;

a central one of said three connecting lines has a linear shape connecting said main feed line to a central one of said three sub-feed lines, the central one of said three sub feed lines being coincident with said main feed line in terms of a center line; and ones on each side of said three connecting lines have arc shapes smoothly connecting said main feed line to ones on both sides of said sub-feed lines, the ones on both sides of said sub-feed lines being orthogonal to said main feed line and extending in mutually opposite directions, respectively.

4. The planar antenna according to claim 3, wherein:

said main feed line, said sub-feed lines, and said connecting lines all have substantially a same line width; and said curved line shapes are arc shapes.

* * * * *